United States Patent [19]

Edman

[11] 4,102,630

[45] Jul. 25, 1978

[54] BURNER CONTROL SYSTEM

[75] Inventor: Hans Per Reinhold Edman, Stockholm, Sweden

[73] Assignee: Sundstrand Corporation, Rockford, Ill.

[21] Appl. No.: 744,378

[22] Filed: Nov. 23, 1976

[51] Int. Cl.[2] ..... F23N 5/00

[52] U.S. Cl. ..... 431/29; 431/38; 431/71

[58] Field of Search ..... 431/29, 30, 31, 38, 431/71, 72

[56] References Cited

U.S. PATENT DOCUMENTS

| | | | |
|---|---|---|---|
| 3,245,456 | 4/1966 | Cox | 431/31 |
| 3,358,735 | 12/1967 | Luft | 431/29 |
| 3,715,180 | 2/1973 | Cordell | 431/31 X |
| 3,795,843 | 3/1974 | Ishida | 431/29 X |
| 3,814,569 | 6/1974 | Jacobsz | 431/29 |

*Primary Examiner*—Edward G. Favors

*Attorney, Agent, or Firm*—Ted E. Killingsworth; William R. Peoples; Michael B. McMurry

[57] ABSTRACT

A burner control system includes a pump for supplying pressurized fuel through a fuel line and a signal-responsive flow valve to a burner nozzle. Also in the system is an ignition control circuit which includes an igniter operable in response to a first signal in the circuit to ignite the fuel. A flame-detecting cell in the circuit causes the termination of the first signal so as to deactivate the igniter when combustion occurs. A second or auxiliary circuit operatively connected to the ignition control circuit includes a first switch responsive to the first signal in the ignition control circuit to cause a second signal to be transmitted to the flow valve for opening the valve to allow pressurized fuel to flow to the nozzle. A second switch in the second circuit serves as an alternate circuit for transmitting the second signal to the flow valve. The second switch is responsive to the pressure of the fuel in the line so that, in the absence of the first signal, the second signal is transmitted to the flow valve only as long as the fuel pressure is maintained above a predetermined high pressure.

7 Claims, 1 Drawing Figure

BURNER CONTROL SYSTEM

BACKGROUND OF THE INVENTION

The present invention relates generally to a burner control system of the type such as may be utilized in home furnaces and water heaters to provide for intermittent burning of fuel in order to maintain a desired temperature level. More particularly, the present invention relates to a burner control system including a pump for delivering the fuel under pressure to a pressure regulating valve and then through a fuel line leading from the regulating valve to a burner nozzle where combustion occurs The flow of fuel through the fuel line is controlled by a flow valve adapted to block the flow of fuel to the nozzle at the end of a burn cycle in the operation of the system.

In burner control systems of the foregoing general character the regulating valve may be constructed so that air which may have accumulated in the system between burn cycles can be purged from the pump so as to avoid an air lock in the pump. One such regulating valve includes a passage bypassing the valve seat and connecting directly to the line leading from the valve to the burner nozzle so that air may be purged from the pump through the nozzle at the start of a burn cycle.

Another similar burner control system includes an ignition control circuit similar to that disclosed herein and, specifically, includes a control thermostat adapted to initiate the burn cycle in response to a demand for heat. When the circuit is made by closing contacts in the thermostat, a motor driven pump is actuated and pressurized fuel is driven by the pump through the regulating valve toward the nozzle. At the nozzle, the fuel is ignited by an igniter responsive to an ignition transformer. The latter is located within the ignition control circuit and is energized at the start of a burn cycle to provide the spark for the igniter to light the fuel. After the fuel is ignited, a light sensitive cell produces a signal in the control circuit to actuate a switching transistor and thereby cause the ignition transformer to de-energize.

In the operation of this type of burner control system, it is desirable to provide a means for blocking the flow of fuel from the regulating valve to the nozzle in the event that the fuel pressure drops below a desired operating pressure to a pressure level at which sufficient fuel may still pass through the regulating valve to maintain a flame that can be sensed by the cell.

SUMMARY OF THE INVENTION

The primary object of the present invention is to provide a burner control system of the foregoing general character in which pressure sensitive means are actuated after the initial phase of a burn cycle to provide the sole control of the flow valve so that, in the event the fuel pressure drops below a predetermined high level, fuel flow from the regulating valve to the nozzle is terminated by closing the flow valve. A more detailed object is to provide in the control system an auxiliary or second circuit including first switch means responsive to a signal in the ignition control circuit for opening the flow valve at approximately the same time that the igniter is activated and additional means for closing the valve during the operation of the burner in the event that the fuel pressure drops below the desired high level.

A further object is to construct the auxiliary circuit so that the signal activating the first switch means is controlled by a lightsensitive cell operable to detect the presence of a flame at the burner nozzle, the signal being terminated when the cell detects the flame. Also, the auxiliary circuit is responsive to pressure sensitive means for maintaining the valve in an open position if sufficient pressure exists in the fuel line and the flame is present.

Advantageously, with a burner control system of the present type, air may be purged through the burner nozzle at the start of each cycle inasmuch as the flow valve is open at about the same time that the igniter is actuated. After the flame is sensed by the light-sensitive cell, the system is further responsive only to the fuel pressure so that should the fuel pressure drop below a desired operating pressure during operation of the burner, the flow valve will be closed to prevent burning of fuel at an undesirable low pressure level.

These and other objects and advantages of the invention will become more apparent from the following detailed description when taken in conjunction with the accompanying drawing.

DETAILED DESCRIPTION OF THE PREFERRED EMBODIMENT

Figure 1:
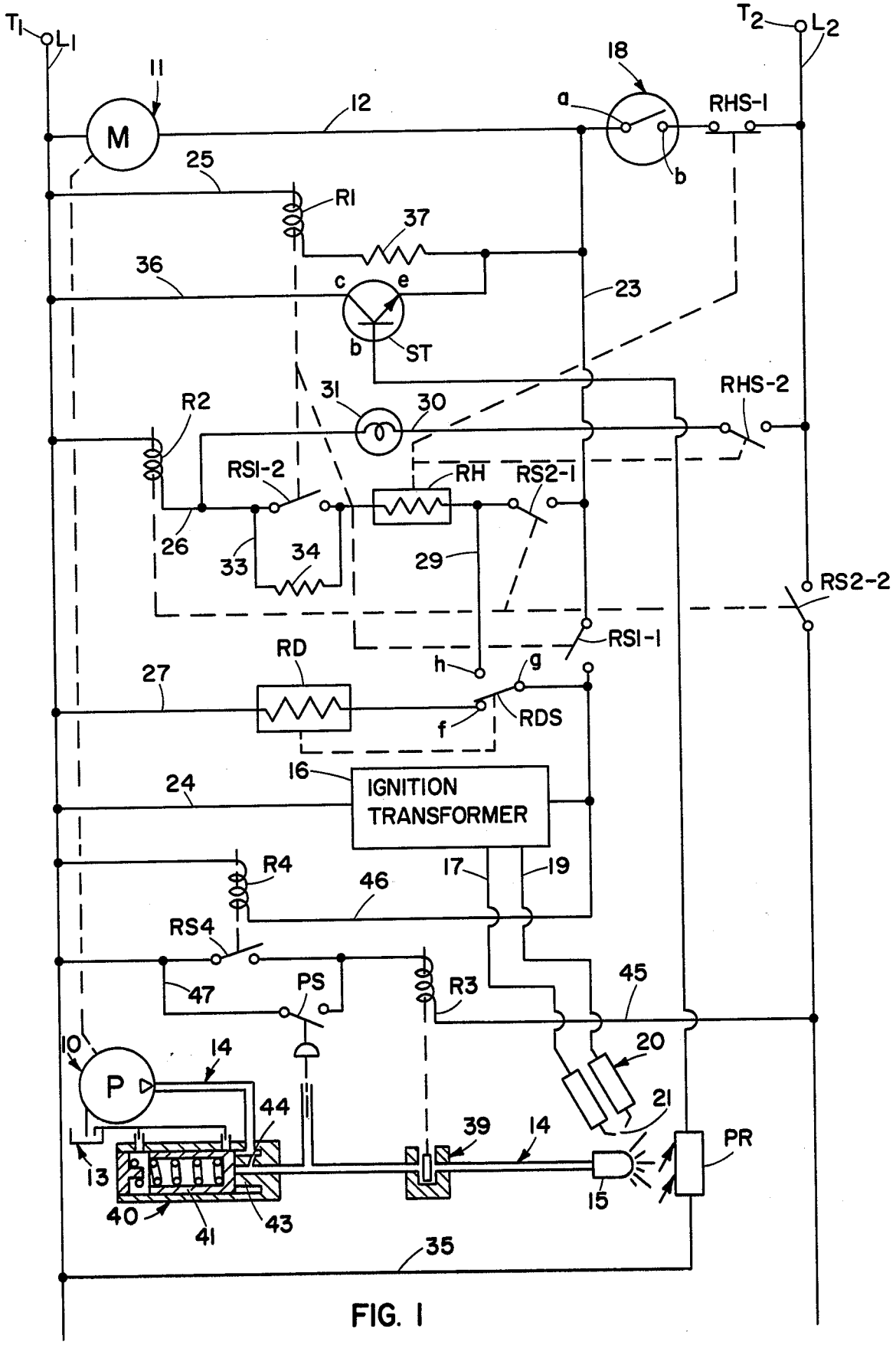
FIG. 1 is a combined electrical and mechanical schematic drawing of a burner control system embodying the novel features of the present invention.

As shown in the drawing for purposes of illustration, the present invention is embodied in a burner control system such as may be used to control the operation of home furnace, boiler or water heater. In particular, the exemplary system provides for intermittent ignition of a combustible fuel such as fuel oil in response to a demand for heat. Herein, the system includes a pump 10 which is driven by a motor 11 to deliver fuel from a source 13 through a line 14 to a burner nozzle 15. Preferably, the motor is electrically powered, being connected by a line 12 of an ignition control circuit between lines L1 and L2 which are connected to a line voltage by terminals T1 and T2. Connected in series with the motor is a thermostat 18 operable to sense a demand for heat and including contacts *a* and *b* which, when closed, normally complete a circuit between the power lines L1 and L2 to apply the line voltage to the motor 11. When the thermostat contacts *a* and *b* are closed and the motor 11 is energized, the pump 10 begins to draw fuel from the source 13 to eventually pump the fuel through the line 14 to the nozzle 15 for combustion purposes. Preferably, the fuel supplied to the nozzle is delivered under high pressure by the pump so that as the fuel exits the nozzle it is atomized for burning.

In order to ignite the fuel, an ignition transformer 16 is connected in parallel with the motor 11 by means of lines 23 and 24. Accordingly, when the line voltage signal is applied to the transformer by means of the thermostat 18, a sufficient voltage signal is applied to lines 17 and 19 to generate a spark across a gap 21 in the igniter 20. This spark serves to ignite the atomized fuel at the nozzle.

In the operation of the exemplary burner system, it is desirable to energize the ignition transformer 16 only long enough for combustion to occur and to de-energize the transformer and shut down the control system if combustion does not occur within a reasonable length of time. Herein, this is achieved through the provision of a time delay relay RD which serves to activate a safety lockout segment of the ignition control circuit and to shut down the control system in the event that ignition does not occur. More specifically, the safety lockout segment is interconnected with the line 12 so that when the thermostat contacts *a* and *b* are closed, a relay R1, located in a line 25 connected across the lines L1 and 23, is energized to close switches RS1-1 and RS1-2.

When the switch RS1-1 is closed, the ignition transformer 16 is energized to provide an electrical arc across the gap 21 of the igniter 20. At the same time that the signal current flows through line 23, the time delay relay RD is energized. As shown in FIG. 1, the time delay relay is located in a line 27 connected in parallel with the relay R1 and extending between lines L1 and 23. Also located in the line 27 is a switch RDS which is controlled by the time delay relay RD. Initially, as the current begins to flow through the line 27, contacts *f* and *g* of the switch RDS are closed but, after a predetermined delay period, the contacts *f* and *g* open and the contacts *g* and *h* close. With the switch RS1-2 of the relay R1 having previously been closed, a circuit through lines 26 and 29 to line 23 is completed and thus provides a current flow through line 26 and hence through a relay R2. Associated with the relay R2 is switch RS2-1 in line 26 and, with switch RS2-1 closed, the relay R2 is kept from being de-energized when the time delay switch RDS contacts *g* and *h* open.

Another component of the safety lockout segment of the ignition control circuit is a relay heater RH connected to line 26. When switches RS1-2 and RS2-1 are closed so an electrical current signal passes through the line 26, the heater RH increases in temperature and upon reaching a predetermined temperature, a switch RHS-1 in line 12 is opened and switch RHS-2 is closed. When the switch RHS-1 opens, the ignition control circuit is de-energized to automatically shut down the system. In order to reactivate the control system, a manual reset switch (not shown) must be closed. At the same time that the switch RSH-1 is opened, the switch RSH-2 is closed, permitting current to flow through line 30 so as to energize a lamp 31 within that line, thereby visually indicating shutdown of the control system.

To avoid shutting down the control system with each burn cycle, a light sensitive, cadmium-type, photoresistive, flamedetecting cell PR is utilized to detect the presence of flame at the burner nozzle 15 and thereby place a switching transitor ST in a conducting state, ultimately resulting in the opening of the switches RS1-1 and RS1-2. Herein, the base of the switching transistor ST is connected in line 35 in series with the light cell PR while the collector and emitter are connected across line 36 which is connected in parallel with the line 25. More particularly, the line 25 includes a relatively high resistance 37 so that when the switching transistor ST is placed in a conductive state, the current will tend to flow through the line 36 instead of line 25, thus bypassing the relay R1. When the switch RS1-1 is open, power is no longer being applied to the ignition transformer and the igniter thus is turned off. when switch RS1-2 is opened, the current passes through a current-limiting resistance 34 in line 33 thereby substantially reducing the current in the relay heater RH to avoid actuating the heater. In this way, the relay switches RHS-1 and RHS-2 are kept from being opened and closed, respectively, so that the ignition control circuit remains energized.

As long as the ignition control circuit is energized, if for some reason the flame at the burner nozzle 15 should go out during a burn cycle, the switch transistor ST would be turned off (no signal from the light cell) and current would again flow through the line 25 to energize the relay R1 resulting in the closing of the switches RS1-1 and RS1-2. The closing of the switch RS1-1 would again energize the ignition transformer 16 to create a spark across the gap 21 of the igniter 20. Thus, if fuel is being delivered to the burner nozzle 15 it will be ignited, the control system thus providing a self-restarting feature. Without fuel sufficient to cause combustion, the heater relay RD eventually will cause switches RHS-1 and RHS-2 to open and close respectively, thereby shutting down the system.

It is desirable in a burner control system of the foregoing general type to provide means for terminating the supply of fuel to the burner nozzle 15 in the event that the fuel pressure drops below a predetermined high level even though the below-level pressure may be sufficient to sustain a flame. Thus, in accordance with the primary aspect of the present invention, the burner control system is constructed in a novel manner so as to be responsive to below normal fuel operating pressures to shut down the system while also providing a through-nozzle air purging capability at the start of each burn cycle. To this end, provision is made of an auxiliary circuit including actuating means for controlling a flow valve 39 to permit the flow of fuel through the fuel line 14 to the nozzle 15 at the start of the cycle for air purging purposes and for closing the valve during the cycle in the event that fuel pressure drops below the afore-mentioned predetermined high pressure. Advantageously, the actuating means utilizes the light cell PR and the switching transistor ST of the ignition control circuit to open the flow valve 39 during an initial period of the burn cycle and to hold the valve in an open position until the fuel is ignited. After the fuel is ignited and the ignition transformer 16 is de-energized, the valve is held in its open position only by means of a pressure switch PS so that, in the event fuel pressure drops, the flow valve is closed.

In the present control system, the pressure of the fuel delivered by the pump 10 is regulated by means of a regulating valve 40 disposed within the line 14 between the pump and the nozzle 15 and the flow control valve 39 is a solenoid actuated valve. Herein, the latter is located within the fuel line 14 between the regulating valve 40 and the nozzle. On the other hand, the regulating valve 40 includes a valve body 41 springloaded against a seat 43 through which essentially all of the fuel flows to the nozzle 15. To avoid hydraulic lock in the pump at the start of a burn cycle, a passage 44 communicating with the fuel line 14 bypasses the valve seat 43 to allow air to be purged from the pump, downstream through the line 14, past the open flow valve 39 and out the nozzle 15. To open the flow valve 39, a coil R3 is located in a line 45 of the auxiliary circuit, the line 45 being connected in parallel with the primary circuit between the two power lines L1 and L2. The coil R3 is energized when a switch RS-4 in line 45 is closed by energizing a relay R4 which is located in line 46. The latter extends between lines L1 and 23 in parallel with the line 24 of the ignition control circuit so that when an electrical current signal flows through line 24, the relay R4 is energized to close the normally open switch RS4.

This, in turn, completes a circuit through the line 45 to energize the coil R3 thereby opening the solenoid valve 39 to enable fuel to flow through the line 14 to the nozzle 15. Advantageously, also located within the auxiliary circuit is the pressure sensitive switch PS. In particular, the latter is disposed within a shunt line 47 that is connected around the switch RS-4 in line 45. In a burn cycle, the pressure sensitive switch PS closes when the magnitude of pressure in the fuel line 14 reaches the desired value so that the de-energizing of the relay R4 and opening of the switch RS-4 will not break the circuit through line 45 and cause the solenoid flow valve 39 to close. To explain it in another way, when the light cell PR senses the presence of flame at the burner nozzle 15, the relay R4 is de-energized as a result of the opening of the switch RS1-1 which controls energizing the ignition transformer 16. The solenoid valve 39, however, is kept in its open position by virtue of the electrical current signal through line 47 around the switch RS-4. But the valve 39 is kept open only as long as the fuel pressure is maintained at or above the desired pressure level of the fuel exiting the nozzle 15. At flame-sustaining pressures below the desired pressure level, it is conceivable that the flame may be re-ignited by virtue of the normal manner of operation of the ignition control circuit. If after successive re-ignitions the fuel pressure fails to reach the desired high level, the relay heater RH eventually reaches its actuation temperature to open switch RHS-1 and close switch RHS-2 thereby shutting down the system and energizing the manual reset lamp 31.

In the normal operation of the control system, it is desirable that the ignition transformer 16 and igniter 20 be energized before opening the flow valve 39 to allow fuel to exit the nozzle 15. Accordingly, a switch RS2-2 is located in line L2 and normally is maintained in an open position until slightly after the ignition transformer is energized. Herein, the switch RS2-2 is controlled by a relay R2 in line 26 and the relay R2 is energized after actuation of the ignition transformer 16. As may be recalled from the earlier description of the ignition control circuit, the time delay relay RD is employed to delay energizing the relay R2 a predetermined period of time after the closing of the switch RS1-1 which, when closed, completes a circuit through line 24 to energize the ignition transformer 16. As a result, the existance of an electrical spark across the gap 21 is assured before opening of the solenoid valve 39 at the beginning of a burn cycle.

From the foregoing, it will be appreciated that the present invention brings to the art a new and improved burner control system, including a unique auxiliary circuit particularly adapted for use in conjunction with the light cell PR and the switching transistor ST to enable the solenoid-actuated flow valve 39 to be opened at the beginning of a burn cycle to purge air through the burner nozzle 15 while still providing a system which is sensitive to the fuel pressure after ignition to shut down the system in the event that the fuel pressure should drop below a desired level even though the lower level fuel pressure may be sufficient to sustain a flame.

I claim:

1. A burner control system comprising a pump for supplying pressurized liquid fuel to a burner nozzle for atomization and combustion, a fuel line leading from said pump to the nozzle, a regulating valve connected within said line between said pump and said nozzle, a passage bypassing said regulating valve and communicating a portion of said line upstream of said regulating valve with a portion of said line downstream of said regulating valve, valve means disposed in said line downstream from said regulating valve and said passage for movement between a first position blocking flow of the fuel from said pump to the nozzle and a second position permitting the flow of fuel from the pump to the nozzle, a first circuit for controlling the ignition of the fuel in a burn cycle by means of a first signal including, a thermostat, igniter means for lighting the fuel discharged from the nozzle in response to a demand for heat sensed by the thermostat, means for de-actuating said igniter means in response to combustion of the fuel at the nozzle, and a second circuit operatively connected to said first circuit and including switch means movable from a first position to a second position for opening said valve means for purging air through said passage and said line at the beginning of the burn cycle in response to said first signal in said first circuit, before the pressurized fuel from said regulating valve is directed to flow through said line to the nozzle, said switch means being adapted for movement from said first position to said second position when said igniter is de-actuated, and means sensitive to the pressure of fuel in said fuel line for maintaining said valve means in its open position as long as the fuel pressure does not drop substantially below a predetermined high pressure during combustion and for causing said valve means to close when the pressure does drop substantially below said predetermined pressure.

2. A burner control system as defined by claim 1 wherein said valve means comprises a solenoid-actuated valve responsive to a second signal carried by said second circuit to move between said closed and open positions.

3. A burner control system as defined by claim 2 wherein said means sensitive to fuel pressure includes pressure-actuated switch means within said second circuit responsive to said high pressure to provide an alternative circuit for said second signal to be transmitted to said valve when said fuel pressure reaches said predetermined pressure.

4. A burner control system as defined by claim 3 wherein said means for de-actuating said igniter means includes a light sensitive cell operable to detect the presence of a flame at said burner nozzle and to transmit a third signal in response thereto, said first-mentioned switch means and said igniter means being operable in response to said third signal for said igniter means to be de-energized and for said second signal to be transmitted to said valve solely by said pressure-actuated switch means when said flame is present.

5. A burner control system as defined by claim 4 wherein said second circuit includes a signal-carrying line connected in parallel with said first circuit, said solenoid valve means including a solenoid coil located within said signal-carrying line for operation of said valve when said second signal is transmitted therethrough, said first mentioned switch means comprising a second coil located in said first circuit and first contacts in said signal-carrying line adapted to be closed in response to said first signal being transmitted through said switch coil thereby to allow said second signal to be transmitted to said solenoid coil, a second line connected in parallel with said first line and around said first contacts, said pressure-actuated switch means including normally open second contacts in said second line adapted to be closed in response to high pressure liquid fuel being pumped through said fuel line.

6. In a burner control system including a pump for supplying pressurized liquid fuel through a fuel line and a signal-responsive flow valve to a burner nozzle, an ignition control circuit having an igniter operable in response to a first signal in said circuit for igniting the fuel, the improvement comprising, a second circuit operatively connected to said ignition control circuit and including first switch means responsive to said first signal in said ignition control circuit to move to a first position to cause a second signal to be transmitted to said flow valve for opening said valve to allow air to be purged from said pump and through said fuel line, and second switch means in said second circuit connected in parallel with said first switch means to provide an alternate circuit for transmitting said second signal to said flow valve in the event said first switch means moves from said first position, said second switch means being responsive to the pressure of said fuel in the fuel line so said second signal is transmitted to said valve only as long as the fuel pressure is maintained above a predetermined high pressure.

7. In a burner control system including a pump for supplying pressurized liquid fuel through a fuel line and a signal-responsive flow valve to a burner nozzle, an ignition control circuit having an igniter operable in response to a first signal in said circuit to ignite the fuel and a flame-detecting cell for causing the termination of said first signal to thereby de-actuate the igniter when combustion occurs, the improvement comprising, a second circuit operatively connected to said ignition control circuit and including a signal-carrying line, a coil located within said signal-carrying line and responsive to a second signal carried by said signal-carrying line to open said flow valve, a second coil within said ignition control circuit, contacts associated with said second coil and located in said signal-carrying line to close when said first signal is transmitted through said ignition control circuit thereby allowing said second signal to be transmitted to said first coil for opening said valve, and a second line connected in parallel with said second coil contacts, a pressure-actuated switch located within said second line and providing an alternative circuit for said second signal to pass to said first coil when the pressure in said fuel line is generally equal to or above a predetermined pressure.

* * * * *